US005866749A

United States Patent [19]

Ou

[11] Patent Number: 5,866,749

[45] Date of Patent: Feb. 2, 1999

[54] SULFUR AND THIOL REMOVAL FROM REACTIVE HYDROCARBONS

[75] Inventor: Di-Yi (John) Ou, Houston, Tex.

[73] Assignee: Exxon Chemical Patents Inc., Houston, Tex.

[21] Appl. No.: 787,485

[22] Filed: Jan. 22, 1997

Related U.S. Application Data

[63] Continuation-in-part of Ser. No. 483,643, Jun. 7, 1995, abandoned, which is a continuation of Ser. No. 383,544, Feb. 3, 1995, abandoned, which is a continuation of Ser. No. 68,942, May 28, 1993, abandoned.

[51] Int. Cl.[6] ..... C07C 7/148; C07C 7/00; C10G 29/00

[52] U.S. Cl. ..... 585/845; 585/848; 585/852; 585/855; 208/246; 208/247; 208/248

[58] Field of Search ..... 585/845, 848, 585/852, 855; 208/246, 247, 248

[56] References Cited

U.S. PATENT DOCUMENTS

| | | | |
|---|---|---|---|
| 1,904,381 | 4/1933 | Morrell | 208/287 |
| 2,768,932 | 10/1956 | Richard et al. | 196/36 |
| 2,897,142 | 7/1959 | Jacobs et al. | 208/212 |
| 2,959,538 | 11/1960 | Weikart et al. | 208/211 |
| 3,145,161 | 8/1964 | Anderson et al. | 208/275 |
| 3,660,276 | 5/1972 | Lacey | 208/212 |
| 3,839,186 | 10/1974 | Berger | 208/8 |
| 3,945,914 | 3/1976 | Yoo et al. | 208/208 R |
| 4,113,606 | 9/1978 | Mulaskey | 208/244 |
| 4,163,708 | 8/1979 | Jacobson et al. | 208/89 |
| 4,204,947 | 5/1980 | Jacobson et al. | 208/243 |
| 4,314,902 | 2/1982 | Bouk et al. | 208/254 |
| 4,440,956 | 4/1984 | Couvillion | 585/260 |
| 4,493,906 | 1/1985 | Couvillion | 502/346 |
| 4,978,439 | 12/1990 | Carnell et al. | 208/91 |
| 5,106,484 | 4/1992 | Nadler et al. | 208/91 |
| 5,130,109 | 7/1992 | Wan | 423/213.2 |
| 5,169,516 | 12/1992 | Carr | 208/189 |
| 5,173,173 | 12/1992 | Vauk | 208/91 |

FOREIGN PATENT DOCUMENTS

| | | |
|---|---|---|
| 0527000A2 | 2/1993 | European Pat. Off. . |
| A332910 | 8/1930 | United Kingdom . |

*Primary Examiner*—Glenn Caldarola
*Assistant Examiner*—In Suk Bullock
*Attorney, Agent, or Firm*—Linda K. Russell

[57] ABSTRACT

Sulfur and mercaptans in reactive hydrocarbon streams are removed by contacting the hydrocarbons at mild temperatures with a hydrogen reduced metal oxide such as a hydrogen reduced copper, zinc and/or aluminum oxide.

11 Claims, No Drawings

SULFUR AND THIOL REMOVAL FROM REACTIVE HYDROCARBONS

This is a continuation-in-part of U.S. Pat. Ser. No. 08/483,643, filed Jun. 7, 1995 which is a continuation of U.S. Pat. Ser. No. 08/383,544, filed Feb. 3, 1995 which is a continuation of U.S. Pat. Ser. No. 08/068,942, filed May 28, 1993, now all abandoned.

FIELD OF THE INVENTION

This invention relates to processes for removal of sulfur from hydrocarbon streams, and more particularly to removal of elemental sulfur and thiols (mercaptans) from hydrocarbons, using metals or compounds of metals from Groups IB, IIB and IIIA of the Periodic Chart of Elements.

BACKGROUND OF THE INVENTION

Removal of elemental sulfur and mercaptan (thiol) contaminants is a frequently encountered problem in the petroleum industries. Some sulfur contaminants such as elemental sulfur are difficult to remove. Others such as mercaptans are very reactive. However, existing sulfur removal methods only often dimerize mercaptans into disulfides. See, e.g. U.S. Pat. No. 5,169,516. The disulfides remain in the hydrocarbon, failing to achieve the goal of sulfur removal. The problem is even more difficult to solve if the hydrocarbon stream contains reactive unsaturates such as acetylenes, diolefins, olefins or aromatics.

Metal oxides and metals, including of the Metal Groups IB, IIB and IIIA, have been used in processes seeking to remove sulfur and sulfur containing compounds. Metal oxides of copper (Group IB) and zinc (Group IIB) have long been used to remove hydrogen sulfide (e.g. $ZnO+H_2S>ZnS+H_2O$). See, for example, U.S. Pat. Nos. 2,959,538, 3,660,276, 4,314,902, 4,978,439, 5,106,484; cf U.S. Pat. No. 5,130,109. Metallic copper or zinc has been used in certain circumstances, normally involving elevated temperatures, in sulfur and sulfur compound removal. For example, see: U.S. Pat. No. 2,768,932 (contacting a hydrofixed, sulfur-containing petroleum distillate with finely divided metallic copper, copper alloys and copper oxides at elevated temperatures up to about 350° C.); U.S. Pat. No. 2,897,142 (contacting a hydrodesulfurized petroleum distillate boiling in the range between 300° F. to 400° F. [149° C.–204° C.] with free copper or silver in the absence of hydrogen); U.S. Pat. No. 3,145,161 (contacting a neutralized, acid treated distillate oil with copper metal at 100° F. to 500° F. [38° C. to 260° C.]); U.S. Pat. No. 3,945,914 (contacting an oxidized sulfur-containing hydrocarbon material with copper or zinc at a temperature from 500° F. to 1350° F. [260° C. to 732° C.]); U.S. Pat. No. 4,113,606 (contacting a refined hydrocarbon feed with particulate copper, iron or zinc or compounds thereof or composites of them and refractory oxides of Groups II to IV metals supported in a binder of a refractory material and having a surface area of 2 to 700 $m^2/gm$); U.S. Pat. No. 4,163,708 (contacting a hydrodesulfurized hydrocracked oil in the absence of molecular oxygen and at a temperature of 120° C. to 400° C. with a composite of a copper or copper compound component and a porous carrier having a surface area of 20 to 1000 $m^2/gm$); U.S. Pat. No. 4,204,947 (absorbing and removing thiol impurities from hydrocarbon oils by contacting the oil in the absence of molecular oxygen with a scavenger at a temperature in the range of about 120° to 400° C.) and U.S. Pat. No. 5,173,173 (contacting feedstock containing naphtha or jet fuel with copper components supported on an alumina-containing porous refractory oxide at temperatures from 200° F. to 700° F. [93° C. to 371° C.] under sulfur absorption conditions, including absence of free hydrogen).

However, none of this art is directed to the problem of removing elemental sulfur or mercaptans from highly unsaturated reactive hydrocarbons especially rich in aromatics, olefins, diolefins or acetylenes. Indeed the art contraindicates possible use of metallic copper or copper oxides for sulfur or mercaptan removal from highly reactive hydrocarbons: copper on a support is taught used as a catalyst for selective hydrogenation of acetylenes in the presence of butadienes; see U.S. Pat. Nos. 4,440,956, 4,493,906. And at temperatures from 200° F. to 260° F. [93° C. to 127° C.] and in the absence of free hydrogen, copper oxide or silver oxide is employed to crack acetylenes in a hydrocarbon stream in which a polymerization inhibitor is used to also prevent polymerization of butadienes. Conditions that include elevated temperature are unsuitable for removal of sulfur and mercaptans from highly reactive hydrocarbons, because at elevated temperatures unsaturated hydrocarbons tend to oligomerize and polymerize, especially the very labile alkyne and diolefin components such as acetylene and butadiene.

My invention is directed to the goal of an effective technique for sulfur and mercaptan removal which does not rely upon operating conditions that involve substantially elevated temperatures, but instead may be conducted at mild conditions, thereby lending the method to application for treating reactive hydrocarbon streams such as butadiene and acetylene.

SUMMARY OF THE INVENTION

In accordance with my invention, there is provided a process for removal of elemental sulfur and mercaptans from a hydrocarbon stream containing reactive unsaturates, which comprises contacting the stream with a hydrogen-reduced metal oxide under mild sulfur and mercaptan removing conditions, said reduced metal oxide being a metal selected from one or more of metals from Groups IB, IIB and IIIA of the Periodic Table of Elements.

The hydrogen-reduced metal oxide is produced by contacting the metal oxide with hydrogen under reducing conditions effective to reduce the metal oxide to elemental metal reactive with elemental sulfur and mercaptans to form sulfides of the metal. Advantageously, the metal oxide is contacted first with a gas consisting of a first predetermined minor amount of hydrogen gas and a major amount of an inert gas at a first temperature in the range from about 100° C. to about 250° C. at a pressure in the range from about 50 to about 1000 psig for a first predetermined period of time effective to reduce a major proportion of the metal oxide to elemental metal, after which said metal oxide is contacted next with a gas consisting of a higher predetermined minor amount of hydrogen gas and a major amount of an inert gas at a higher temperature in the range from about 175° C. to about 300° C. at a pressure in the range from about 50 to about 1000 psig for a second predetermined period of time effective to reduce a major remaining proportion of the metal oxide to elemental metal. Suitably, the metal oxide is an oxide of copper, zinc, aluminum or mixtures thereof.

DESCRIPTION OF THE PREFERRED EMBODIMENT

In accordance with my invention, free (elemental) sulfur and mercaptans (thiols) are removed, preferably to a level less than 0.1 ppm, from a hydrocarbon stream containing reactive unsaturates such as aromatics, diolefins and acetylenes. The method of this invention is especially suited to removal of sulfur and mercaptans from a hydrocarbon stream containing a major proportion of a reactive diolefin, for example, 1,4-butadiene, or from a fuel rich in aromatics, such as aviation gasoline.

As employed in this application, the terms "mercaptan" and "thiol" refer to compounds of the general formula R-SH wherein "R" means an alkyl group, normally one of from one to ten carbon atoms, and "SH" means a sulfhydryl group, sometimes called a mercapto group.

As mentioned, I employ a hydrogen-reduced metal oxide selected from oxides of Group IB, IIB, and IIIA and mixtures thereof. Especially suitable are reduced metal oxides of copper, zinc and aluminum. The metal oxides are reduced by contacting them with a gas consisting of a major volume percentage of an inert gas and a minor volume percentage of hydrogen gas at a temperature in the range from about 100° C. to about 300° C. at a pressure in the range from about 50 to 1000 psig.

Preferably, the metal oxide reduction is accomplished in at least a two step reduction to control heats of reaction and reduce the oxides efficiently. Accordingly, the metal oxide(s) is contacted first with a gas consisting of a first predetermined minor amount of hydrogen gas and a major amount of an inert gas at a first temperature in the range from about 100° C. to about 250° C. at a pressure in the range from about 50 to about 1000 psig for a first predetermined period of time effective to reduce a major proportion of the metal oxide to elemental metal, after which the metal oxide in mixture with already reduced metal oxide is contacted next with a gas consisting of a higher predetermined minor amount of hydrogen gas and a major amount of an inert gas at a higher temperature in the range from about 175° C. to about 300° C. at a pressure in the range from about 50 to about 1000 psig for a second predetermined period of time effective to reduce a major remaining proportion of the metal oxide to elemental metal. Thus, in a preferred embodiment, mixed metal oxides of copper oxide, zinc oxide and alumina powder are exposed first to an atmosphere of about 99% nitrogen and 1% hydrogen at a temperature of about 160° C. and a pressure of about 200 psig for about 24 hours, then to an atmosphere of about 98% nitrogen and 2% hydrogen at a temperature of about 200° C. and a pressure of about 200 psig for about 24 hours.

Preferably the reduced metal oxide has a surface to volume ratio sufficient for presenting elemental metal to sulfur and mercaptans in said hydrocarbon stream effective to remove sulfur or mercaptans from said stream to a level less than 0.1 ppm.

After the reduced metal oxides are formed, they are maintained in an oxygen free environment until ready for use.

In the method of this invention, elemental sulfur and mercaptans in a hydrocarbon stream containing reactive unsaturates, are removed by contacting the stream with a hydrogen-reduced metal oxide (suitably prepared as just described) under mild sulfur and mercaptan removing conditions, preferably at temperatures less than about 100° F., more preferably at temperatures less than about 90° F., and most preferably at ambient temperature, and preferably for a time sufficient to reduce the sulfur or mercaptan content of the hydrocarbon stream to less than 0.1 ppm.

The removal mechanism is believed to involve the formation of metal sulfide. The reduction of metal oxides provides fresh metal surface which is much more reactive toward sulfur than plain metal, which is usually protected by a thin layer of surface oxides. Another advantage of the reduced metal oxides is their porosity. Metal oxide could be made porous via the addition of a porous binder such as alumina, silica, and clay. The porosity increases the scavengers' surface area which improves the removal efficiency.

EXAMPLE 1

This example illustrates the preparation of the sulfur and mercaptan removing scavengers of this invention. A mixed metal oxides containing 33% copper oxide, 33% zinc oxide, and 34% alumina in the form of pellets was obtained from Katalco Corp, 1100 Hercules, Houston, Tex. 77058. The metal oxides pellets were ground to 40/60 mesh particles and reduced first in an atmosphere of 99% nitrogen/1% hydrogen at 325° F. (163° C.) and 200 psig for 24 hours, followed by an atmosphere of 98% nitrogen/2% hydrogen at 400° F. (204° C.) and 200 psig for another 24 hours. The reduced metal oxides so produced were used in the following Examples.

EXAMPLE 2

This example illustrates the effectiveness of the scavenger produced in Example 1 in removing elemental sulfur from aviation gasoline. The aviation gasoline used in this test contained 3.3 ppm of elemental sulfur. Five grams of the reduced metal oxides produced in Example 1 were mixed with 50 cc of the aviation gasoline in a sealed bottle at ambient temperature and atmospheric pressure for two hours. The liquid phase was removed from the bottle was then sampled and analyzed by polarograph, which showed that the elemental sulfur concentration was reduced from 3.3 ppm to less than 0.1 ppm.

COMPARATIVE EXAMPLE 3

One of the commonly used mercaptan scavengers is caustic-treated lime. The basic lime absorbs the acidic mercaptans through an acid-base reaction which removes them from hydrocarbons. The problem is that basic materials catalyze the dimerization of mercaptans. To illustrate this point, a caustic-treated lime ("Sofnolime" from Molecular Products Ltd., Houston, Tex.) was used to treated a butadiene stream containing 45 ppm methyl mercaptan. Ten grams of the causticized lime was allowed to equilibrate with 65 gram of butadiene in a dosed stainless steel cylinder at ambient temperature and 100 psig over night. After the equilibration, analysis of the butadiene showed that it contained is less than 0.1 ppm methyl mercaptan. However, as much as 2 ppm dimethyl disulfide, which was not originally present in the feed, was detected. The presence of dimethyl disulfide could be accounted for only by the dimerization of methyl mercaptan. The goal of sulfur removal therefore was not accomplished.

EXAMPLE 4

This example illustrates the effectiveness of the reduced metal oxide scavengers from Example 1 in removing methyl mercaptan from butadiene as opposed to converting the mercaptan to a disulfide still resident in the butadiene. The reduced metal oxide scavenger was loaded into a 1/4"×3" stainless steel column. A butadiene stream containing 45 ppm of methyl mercaptan was pumped through the column at a liquid hourly space velocity of 1 $hr^{-1}$ at ambient temperature and 60 psig. Column effluent was sampled periodically and analyzed for sulfur. It was found that even after being on stream for five days, the effluent still contained less than 0.1 ppm methyl mercaptan and less than 0.1 ppm dimethyl disulfide, indicating the superior performance of the hydrogen reduced mixed copper, zinc and aluminum metal oxide sulfur scavengers.

Having now described my invention, it will be understood not limited to the scope of the specific examples and embodiments set forth above, but as encompassing all variations included within the scope of the appended claims.

I claim:

1. A process for removal of elemental sulfur and mercaptans from a hydrocarbon stream containing reactive olefins and aromatics, which comprises:

contacting said stream with a hydrogen-reduced metal oxide under mild sulfur and mercaptan removing conditions at temperatures less than about 100° F. said reduced metal oxide being a metal selected from one or more of metals from Groups IB, IIB and IIIA of the Periodic Table of Elements.

2. The process of claim 1 in which said hydrogen-reduced metal oxide is produced by contacting the metal oxide with hydrogen under reducing conditions effective to reduce the metal oxide to elemental metal reactive with elemental sulfur and mercaptans to form sulfides of the metal.

3. The process of claim 1 in which said metal oxide is an oxide of copper, zinc, aluminum or mixtures thereof.

4. The process of claim 1 in which said hydrogen-reduced metal oxide has a surface to volume ratio sufficient for presenting elemental metal to sulfur and mercaptans in said hydrocarbon stream effective to remove sulfur and mercaptans from said stream to a level less than 0.1 ppm.

5. The process of claim 2 wherein said metal oxide is contacted with a gas consisting of a major volume percentage of an inert gas and a minor volume percentage of hydrogen gas at a temperature in the range from about 100° C. to about 300° C. at a pressure in the range from about 50 to 1000 psig.

6. The process of claim 2 wherein said metal oxide is contacted first with a gas consisting of a first minor amount of hydrogen gas and a major amount of an inert gas at a first temperature in the range from about 100° C. to about 250° C. at a pressure in the range from about 50 to about 1000 psig for a first period of time effective to reduce a major proportion of the metal oxide to elemental metal, after which said metal oxide is contacted next with a gas consisting of a higher minor amount of hydrogen gas and a major amount of an inert gas at a higher temperature in the range from about 175° C. to about 300° C. at a pressure in the range from about 50 to about 1000 psig for a second period of time effective to reduce a major remaining proportion of the metal oxide to elemental metal.

7. The process of claim 6 in which said metal oxide is contacted first with a gas consisting of 99 vol. % nitrogen and 1 vol. % hydrogen at a temperature of about 160° C. and a pressure of about 200 psig for about 24 hours, then with a gas consisting of 98 vol. % nitrogen and 2 vol. % hydrogen at about 200° C. at a pressure of about 200 psig for about 24 hours.

8. The process of claim 1 in which said hydrocarbon stream contains a major proportion of a reactive diolefin.

9. The process of claim 8 in which said diolefin is 1,4-butadiene.

10. The process of claim 1 in which said hydrocarbon stream is a gasoline containing a major proportion of aromatic hydrocarbons.

11. A process for removing mercaptans from a hydrocarbon stream including butadiene, which comprises:

(a) exposing mixed metal oxides of copper oxide, zinc oxide and alumina powder first to an atmosphere of about 99% nitrogen and 1% hydrogen at a temperature of about 160° C. and a pressure of about 200 psig for about 24 hours, then to an atmosphere of about 98% nitrogen and 2% hydrogen at a temperature of about 200° F. and a pressure of about 200 psig for about 24 hours, and (b) contacting said hydrocarbon stream with the hydrogen-reduced mixed metal oxides from step(a) at temperatures less than about 100° F. for a time sufficient to reduce the mercaptan content of the hydrocarbon stream to less than 0.1 ppm.

* * * * *